US006543929B1

(12) United States Patent
Agnoff

(10) Patent No.: US 6,543,929 B1
(45) Date of Patent: Apr. 8, 2003

(54) OSCILLATING WATCH WINDER

(76) Inventor: Charles Agnoff, 1221 Great Oaks Dr., Wilmington, NC (US) 28405

( * ) Notice: Subject to any disclaimer, the term of this patent is extended or adjusted under 35 U.S.C. 154(b) by 0 days.

(21) Appl. No.: 09/940,307

(22) Filed: Aug. 27, 2001

(51) Int. Cl.[7] ..... G04B 5/00
(52) U.S. Cl. ..... 368/206; 368/327
(58) Field of Search ..... 368/206, 49–50, 368/327

(56) References Cited

U.S. PATENT DOCUMENTS

| | | | | |
|---|---|---|---|---|
| 2,863,345 | A | | 12/1958 | Fiechter |
| 2,917,955 | A | | 12/1959 | Leger |
| 2,926,519 | A | | 3/1960 | Setterberg |
| 3,620,007 | A | | 11/1971 | Kauffman |
| 4,057,958 | A | | 11/1977 | Wauntch |
| 5,608,693 | A | | 3/1997 | Richards |
| 5,988,871 | A | | 11/1999 | Bonnet |
| 6,254,270 | B1 | * | 7/2001 | Agnoff ..... 368/206 |
| 6,439,761 | B1 | * | 8/2002 | Agnoff ..... 368/206 |

FOREIGN PATENT DOCUMENTS

| | | | |
|---|---|---|---|
| GB | 2233477 | * | 9/1991 |
| JP | 352043457 A | * | 4/1977 |

* cited by examiner

*Primary Examiner*—David Martin
*Assistant Examiner*—Michael L. Lindinger
(74) *Attorney, Agent, or Firm*—MacCord Mason PLLC

(57) ABSTRACT

An apparatus for winding self-winding watches is described that includes a watch carrier having an axis of rotation of 90° above horizontal and a center of gravity offset from the axis of rotation in a given direction, the watch carrier being adapted to support a watch with the plane of the watch face being perpendicular to the axis of rotation; and a drive means for rotating the carrier about the axis until the given direction is above the axis, whereupon the carrier is released to freely rotate about the axis in an oscillating motion to wind the watch.

27 Claims, 3 Drawing Sheets

OSCILLATING WATCH WINDER

BACKGROUND OF THE INVENTION (1) Field of the Invention

The present invention relates generally to automatic watch winders for winding self-winding watches, and in particular to watch winders that impart a winding motion to watches in a manner similar to the motion imparted when the watch is worn.

(2) Description of the Prior Art

The winding mechanism of a self-winding watch is comprised of a ball bearing mounted pendulum or rotor that is connected through a gear reduction system to the mainspring of the watch. Generally, the rotor can rotate 360° in either direction. However, there are also so-called "hammer" shaped rotors in older self-winding watches that have a limited travel of 150° to 220° rotation. In either case when the watch is worn, the user's random and often rapid arm movements cause the rotor to swing back and forth inertially in both directions around the rotor axis, thereby winding the watch spring. The watch spring generally stores sufficient energy to keep the watch operating 36–48 hours, whether worn or not. Thus, when worn daily, the watch will be sufficiently wound to maintain continuous operation. However, if the watch is not worn regularly, the user must wind the watch, either manually or with a watch winder, or the watch will stop.

Prior art watch winders are typically comprised of an electric drive mechanism that rotates a watch carrier adapted to hold a watch with the plane of the watch perpendicular to the axis of rotation. That is, the rotor axis is parallel to the axis of rotation of the drive mechanism, so that the watch rotates in the same plane as the hands of the watch. During the period of activation, the watch is completely rotated several times either in a clockwise or counter-clockwise direction or, alternately, reversing in both directions. During the 360° rotation of the watch, the rotor hangs downward, so that the watch rotates while the rotor is essentially stationary and the winding action is totally caused by gravity operation. That is, the motion is essentially the opposite from the way in which the winding mechanism is designed, i.e., rotation of the rotor around the rotor axis caused by inertial movement resulting from the wearer's random movements. As a result, the powered rotation of the watch must be controlled to limit the turns per day (TPD) to prevent damage or malfunction due to the forces exerted on the winding mechanism.

U.S. Pat. No. 6,254,270, issued Jul. 3, 2001, describes an alternative watch winder design in which a self-winding watch is mounted on a horizontal or inclined, e.g., 30°, shaft or spindle, with the watch band being positioned around the spindle so that the face of the watch is generally parallel to the axis of rotation, and moves along a circular pathway during rotation of the spindle. The orbital motion of the watch about the inclined axis causes the rotor to swing back and forth, or oscillate, thereby generally replicating the effect of a person's natural arm movements. When a 30° angle from horizontal is chosen, each rotation causes the rotary pendulum to move through an arc of 120°.

While this latter mechanism more closely simulates the natural forces to which the watch is subjected when worn, there is still a need for a device that will impart a greater oscillation to the rotor, more closely simulating the bi-directional random inertial movement to which an automatic watch is subjected when worn, and which will enable an automatic watch to be adequately wound in a shorter period of time without any concern for winding direction, and also requiring less energy.

SUMMARY OF THE INVENTION

The present invention is directed to a watch winder for winding automatic watches in a manner that closely approximates the way in which automatic watches are wound when worn. Moreover, the present invention permits winding of automatic watches rapidly regardless of the winding direction required by a particular watch, and with reduced energy requirements compared to prior art devices.

Generally, the present watch winder achieves these results by providing a watch carrier holding one or more watches having a horizontal or inclined axis of rotation with the center of gravity of the carrier being laterally offset in a given direction from the axis of rotation, and a drive mechanism to rotate the watch carrier around the axis until the given direction, or center of gravity, is in the uppermost position, whereupon the carrier is free to rotate about the axis under the influence of both gravity and inertial force, causing the carrier to oscillate around the axis bi-directionally for several excursions.

The watch or watches is supported on the watch carrier with the face of the watch being perpendicular to the axis of rotation of the carrier. That is, the axis of rotation of the watch pendulum or rotor is parallel to the axis of rotation of the carrier. As a result, the rapid oscillation of the watch carrier and the abrupt direction changes cause the rotor to spin about the rotor axis in much the same manner as the spinning that occurs when the watch is worn by a user. Moreover, since the rotor tends to spin entirely or largely around the rotor axis for several excursions, as opposed to only the single 120° or so achieved with prior art devices, the watch is more rapidly wound, and less energy is required, prolonging battery and/or winder life.

More specifically, the powered drive mechanism used to rotate the carrier is comprised of a shaft rotated by electric motor that is connected to the shaft through a set of reduction gears. The shaft is preferably rotated at from about 10 to about 12 revolutions per hour (rph). Alternately, a control system can be programmed to provide a single revolution with a variable "sleep" time between cycles (every 5 to 6 minutes). The shaft engages the watch carrier upon rotation and rotates the shaft until the center of gravity of the carrier reached the apex of rotation, i.e., until the direction of the center of gravity from the rotational axis extends vertically upward. For example, a torque arm may extend laterally from the shaft, with the outer end of arm moving along a circular pathway upon rotation of shaft to push against an element on the watch carrier. The same rotation action can also be generated by a stepper motor, rotary solenoid, bellcrank drive, or other rotary drive means.

The watch carrier includes a watch support to hold one or more watches with the watch face perpendicular to the axis of rotation of the carrier, thus aligning the rotor axis parallel to the axis of rotation of the carrier. The axis of rotation may extend through the center of the watch, as when the carrier is designed to only support one watch. Alternatively, if the carrier is designed to support a plurality of watches, the watches can be offset from the carrier axis. The watch carrier may include a watch support that is removably held within a recess in the carrier.

The element on the carrier that is engaged by the torque arm may be a projection that extends from the carrier into the pathway of the torque arm. The projection is offset from the carrier axis in the same direction as the center of gravity of the carrier. Preferably, the watch support positions the watch so that the watch is in an upright position, facilitating the viewing of the watch time, when center of gravity of the watch carrier is in a downward direction which is the normal rest position. The center of gravity can be offset from the carrier axis due to the design of the carrier, or by attaching a counterweight to one side of the carrier.

Different styles of automatic watches have different winding requirements, normally determined by the number of desired rotations of the rotor within a given time period, e.g., a twenty-four hour period. Therefore, the length of time that the watch winder is activated and the length of time between activations should be set to meet the specifications of the watch being wound. The present invention provides a controller for use in setting these parameters. Rotation direction may also be set by the controller but the inherent bi-directional oscillating action of the winder does not make this mandatory.

In addition, the controller can be used to deactivate the motor when the torque arm is at the apex of its pathway, thereby avoiding contact of the torque arm with the carrier during the carrier oscillation, and allowing the oscillations to stop before the arm again engages the carrier. The watch winder may be mounted in a case that can include a hinged lid to enclose the watch carrier. Control knobs or switches can be mounted on the case to adjust the controller.

In operation, the drive mechanism is periodically energized in accordance with the specifications of the watch to be wound. Rotation of the shaft causes the torque arm to push against a part of the carrier, rotating the carrier until the center of gravity of the carrier is above the shaft. For example, if the carrier includes a counterweight on one side, so that the weighted side is heavier, the shaft will rotate the carrier until the weighted side of the carrier is at the apex of the rotation. Upon reaching the apex, gravity causes the watch carrier to rotate at a speed greater than the speed of rotation of the shaft, disengaging the carrier from the torque arm.

The weighted side of the carrier is then carried past the bottom or lowest point of the pathway by its momentum to a point near the apex on the opposite side of the pathway, whereupon the direction of rotation of the watch carrier is reversed. The cycle is repeated through multiple oscillations of decreasing length until the carrier comes to rest with the weighted side of the carrier at the bottom position, or until the carrier is again engaged by the drive mechanism to return the weighted side of the carrier to the top of its circular pathway. If desired, the drive mechanism can be de-energized during oscillation of the carrier to prevent the drive mechanism from engaging the carrier during oscillation.

Oscillation of the watch carrier causes a corresponding oscillation of the watch rotor which spins rapidly around the rotor axis thereby winding the watch in a manner closely simulating the spinning of the rotor that occurs during normal winding of the watch when the watch is worn by a user. The time required to wind the watch, the need for bi-directional rotation, and the energy required, is also substantially reduced due to the greater rotation of the rotor.

DETAILED DESCRIPTION OF THE INVENTION

In the following description, terms such as horizontal, upright, vertical, above, below, beneath, and the like, are used solely for the purpose of clarity in illustrating the invention, and should not be taken as words of limitation. The drawings are for the purpose of illustrating the invention and are not intended to be to scale.

Figure 1:
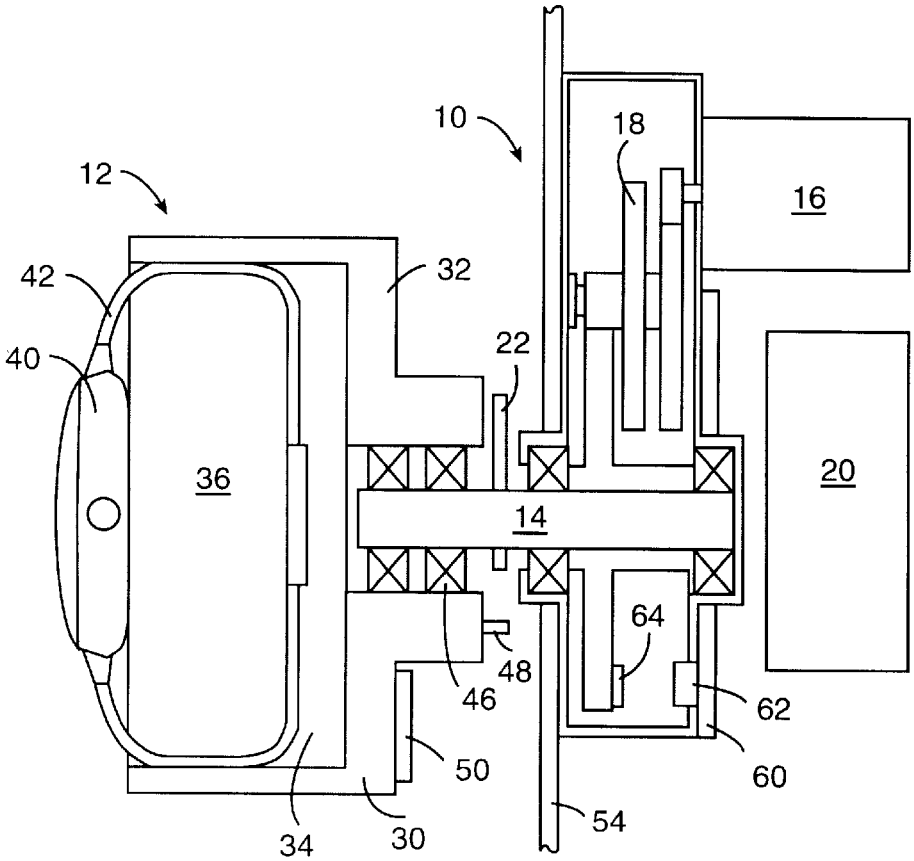
FIG. 1 is sectional side view of a watch winder supporting one watch.
Figure 2:
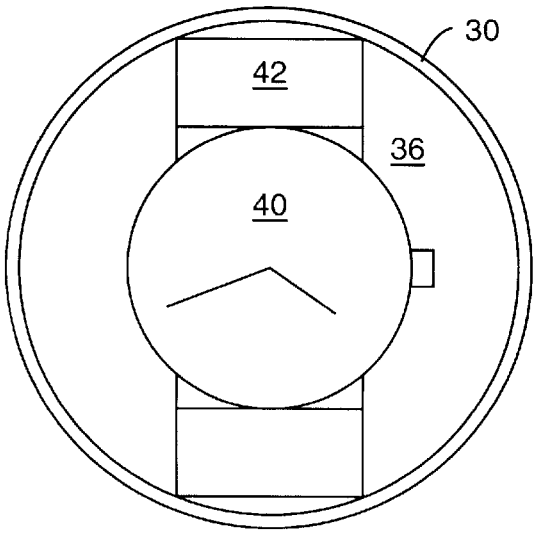
FIG. 2 is a front view of a watch carrier supporting one watch.
Figure 3:
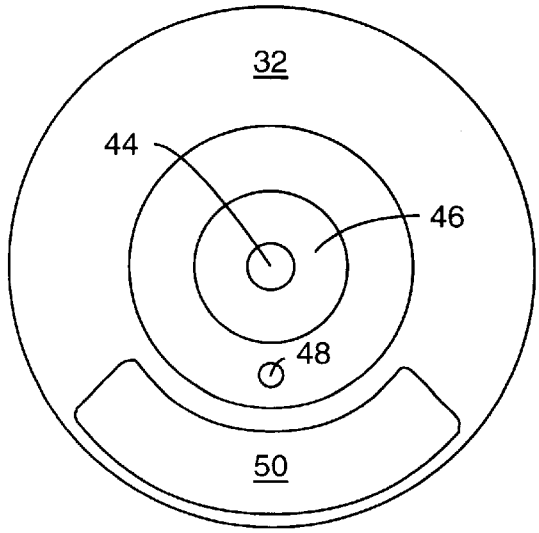
FIG. 3 is a rear view of the watch carrier of FIG. 2.

As best shown in FIG. 1, the oscillating watch winder of the present invention is comprised of a drive mechanism, generally 10, and a watch carrier, generally 12. Drive mechanism 10 is comprised of a rotatable shaft 14 driven by electric motor 16 connected to shaft 14 through a set of reduction gears 18. Battery 20 powers motor 16. A torque arm 22 extends laterally from shaft 14, with the outer end of arm 22 moving along a circular pathway upon rotation of shaft 14 by motor 16. Shaft 14 is preferably aligned horizontally, but may be ±60° of horizontal, and preferably within ±45° of horizontal.

Watch carrier 12 is comprised of a molded cup 30 having a rear face 32 toward drive mechanism 10, and an open cavity 34 facing away from drive mechanism 10. A cushioned watch support 36 is adapted to fit within cavity 34 and support a watch 40 with band 42 of watch 40 extending around watch support 36 when watch 40 is mounted on watch carrier 12. Preferably, watch 40 is supported in an upright position when counterweight 50 is at its lowest point.

Rear face 32 of watch carrier 12 includes a central bore 44 for receiving shaft 14. Bore 44 is surrounded by bearings 46 or a friction reducing bushing, so that watch carrier 12 is freely rotatable on shaft 14. A torque arm engaging projection in the form of pin 48 extends rearwardly from rear face 32 into the pathway of torque arm 22. Pin 48 is offset in a given direction from shaft 14. A counterweight 50 is also mounted on rear face 32 in the same given direction. Preferably, watch 40 is mounted in watch carrier 12 so that watch 40 is in an upright position facilitating viewing when the given direction is downward, i.e., when counterweight 50 is beneath shaft 14.

Figure 4:
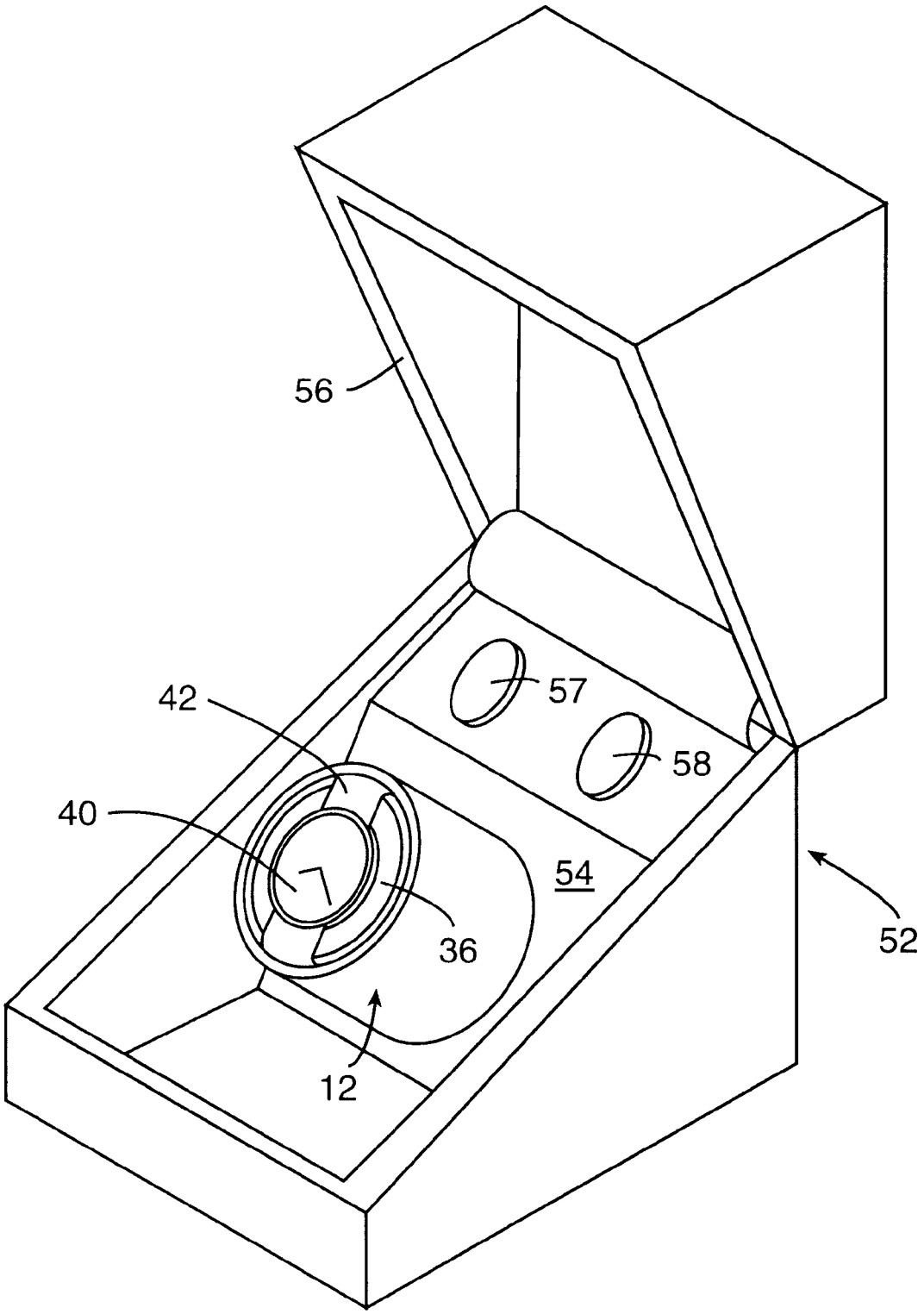
FIG. 4 is a prospective view of the watch winder of FIG. 1 within a case.

As shown in FIG. 4, the watch winder is mounted within case 52 that includes a mounting plate 54 to support the watch winder with drive mechanism 10 within the interior of case 52 beneath plate 54 and watch carrier 12 on the exterior of plate 54. A hinged lid 56 encloses watch carrier 12 when case 52 is closed. Controls 57 and 58 communicate with controller 60 to control the direction of rotation of shaft 14 and the time periods during which drive mechanism 10 is activated. Controller 60 also includes an infrared reflective sensor 62 to sense when pin 48 is at the uppermost position by sensing reflection from reflector 64. Microswitches, magnetic reed switches or other sensing devices may also be employed for this function.

Figure 5:
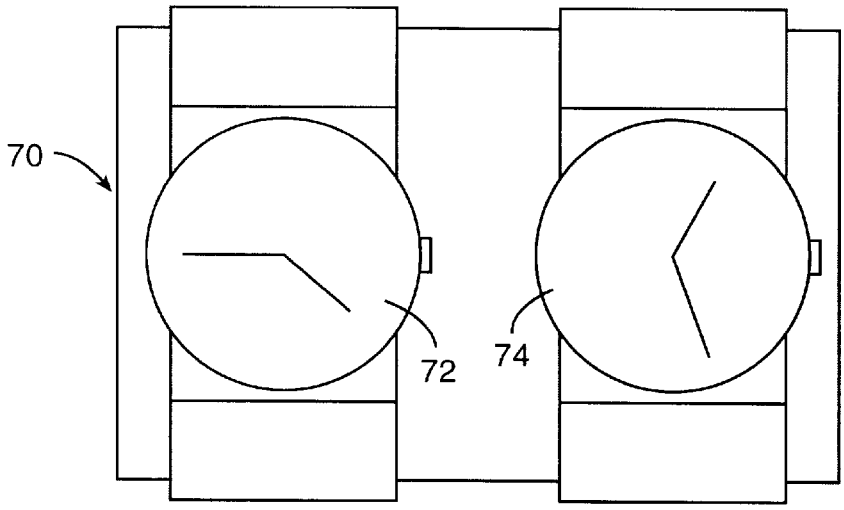
FIG. 5 is a front view of an alternative watch carrier supporting two watches.
Figure 6:
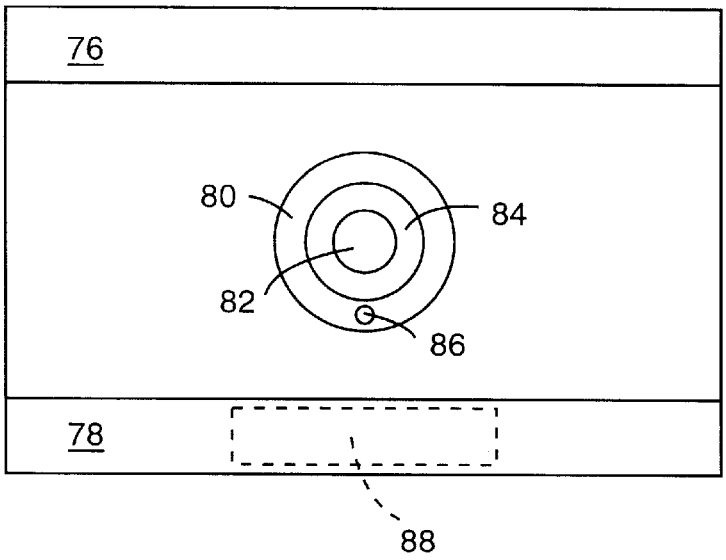
FIG. 6 is a rear view of the watch carrier of FIG. 5.
Figure 7:
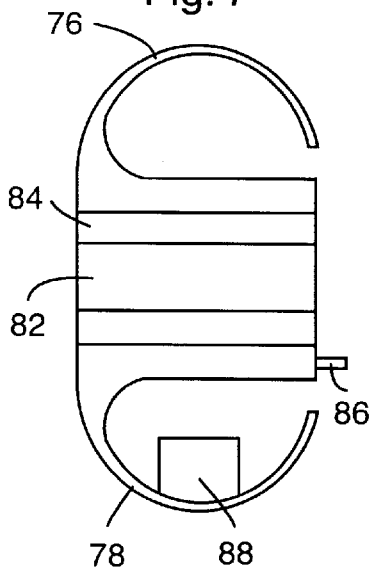
FIG. 7 is a side view of the watch carrier of FIG. 6.

FIGS. 5–7 illustrate an alternative watch carrier, generally 70, that is adapted to support at least 2 watches, illustrated as watches 72 and 74, with their faces perpendicular to shaft 14. Watch carrier 70 includes curved upper and lower edges 76 and 78, respectively, so that carrier 70 can be flexed to facilitate mounting of watches, particularly watches with leather bands. Rear face 80 of carrier 70 corresponds to rear face 32 of carrier 12, and includes a bore 82, surrounded by friction reducing bushing 84, for receiving shaft 14. Pin 86 projects rearwardly from rear face 80 into the pathway of the outer end of torque arm 22 when carrier 70 is mounted on shaft 14. Pin 86 is offset from bore 82 in a given direction. A counterweight 88 is positioned on the lower side of carrier 70 beneath bore 82.

In operation, as illustrated in FIGS. 1–4, motor 16 is periodically energized to rotate shaft 14 in either a clockwise or counterclockwise direction. The length of time that motor 16 is energized, and the length of time between the period when motor 16 is energized, will depend on the particular watch design. As shaft 14 rotates, the outer end of torque arm 22 moves along a 360° circular pathway to push against rearwardly extending pin 48. Upon engagement of pin 48 by arm 22, watch carrier 12 is rotated until pin 48 is carried to the apex or top of the circular pathway. Upon reaching the apex, the gravitational force on counterweight 50 causes watch carrier 12 to rapidly rotate on shaft 14 at a rotational speed greater than the speed of rotation of shaft 14, separating carrier 12 from arm 22. Counterweight 50 is then carried beyond the bottom or lowest point of the pathway by its momentum to a point near the apex on the opposite side of the pathway. The direction of watch carrier 12 is then reversed. The cycle is repeated through multiple decreasing oscillations of watch carrier 12 until counterweight 50 stops at the bottom position, or until arm 22 once again engages pin 48 to again move counterweight 50 to the top of its circular pathway. If desired, sensor 62 can be used to de-energize motor 16 when torque arm 22 is at the apex of its pathway, so that pin 48 will not engage arm 22 during oscillation of carrier 12.

This sequence of oscillations causes the rotor within watch 40 to spin rapidly thereby winding the watch in a manner closely simulating the spinning of the rotor that occurs during normal winding of the watch when the watch is worn by a user. Due to the forces that are exerted, the rotor spins around the watch shaft during the oscillations, as opposed to the partial rotation observed in prior art mechanisms. Therefore, the time required to wind the watch, and the energy required, is substantially reduced. Moreover, since the rotor is spinning about the shaft, as opposed to merely being held in a downward position while the watch is rotated, winding more closely approximating the design mechanism is achieved, thereby putting less wear on the watch.

Certain modifications and improvements will occur to those skilled in the art upon a reading of the foregoing description. It should be understood that all such modifications and improvements have been deleted herein for the sake of conciseness and readability but are properly within the scope of the following claims.

What is claimed is:

1. An apparatus for winding self-winding watches having a rotor and a face comprising:

a) a watch carrier having an axis of rotation of less than 90° above horizontal and a center of gravity offset from said axis of rotation in a given direction, said watch carrier being adapted to support said watch with the plane of said watch face being perpendicular to said axis of rotation; and b) a drive means for rotating said carrier about said axis until said given direction is above said axis, whereupon said carrier is released to freely rotate about said axis with said given direction being carried bi-directionally beneath said axis in an oscillating motion to spin said rotor to wind said watch.

2. The apparatus of claim 1, wherein said drive means includes a rotatable shaft along said axis and a torque arm extending outwardly from said shaft, said torque arm engaging said carrier upon rotation.

3. The apparatus of claim 1, wherein said axis is at about 0° to about 45° from horizontal.

4. The apparatus of claim 1, wherein said watch carrier is adapted to support a plurality of watches.

5. The apparatus of claim 1, wherein said drive means is an electrically powered motor or rotary solenoid.

6. The apparatus of claim 1, further including a housing supporting said shaft, drive means and watch carrier.

7. The apparatus of claim 1, wherein said carrier includes a counterweight offset from said shaft in said given direction.

8. The apparatus of claim 1, wherein said carrier is adapted to support a watch in the upright position when said given direction is in the downward direction.

9. The apparatus of claim 1, further including a controller to control activation of said drive mechanism.

10. An apparatus for winding self-winding watches including a rotor, a watch face and a band comprising:

a) a rotatable shaft having a given axis and an outer end, said shaft being at an angle of less than 90° above horizontal;

b) a torque arm having an outer end moveable along a circular pathway upon rotation of said shaft;

c) a watch carrier freely rotatable on the outer end of said shaft, said carrier having a center of gravity offset from said shaft in a given direction, and a torque arm engagement projection offset from said axis in said given direction and positioned within the pathway of said torque arm outer end; and d) a drive means for rotating said shaft, said torque arm engaging said torque arm engagement projection upon rotation of said shaft until said counterweight reaches the apex of said rotation, whereupon said carrier is released to freely rotate about said axis with said counterweight being carried bi-directionally beneath said axis in an oscillating motion to spin said rotor to wind said watch.

11. The apparatus of claim 10, wherein said watch carrier includes an open-front cavity, and said watch support is insertable into said cavity, said watch band being positionable around said support.

12. The apparatus of claim 10, wherein said torque arm is perpendicular to said axis.

13. The apparatus of claim 10, wherein said carrier includes a rear face with a shaft receiving bore, said torque arm engaging projection being offset from said bore and extending from said rear face, said shaft being freely rotatable within said bore.

14. The apparatus of claim 10, wherein said shaft is upwardly inclined at an angle of from about 0° to about 45° above horizontal.

15. The apparatus of claim 10, further including a housing with a support plate with inner and outer sides, said watch carrier being on the outer side of said plate and said drive means being on the inner side of said plate.

16. The apparatus of claim 10, wherein said drive means is connected to said shaft through reduction gears.

17. The apparatus of claim 10, wherein said torque arm engagement projection is a rearwardly extending pin.

18. The apparatus of claim 10, including a counterweight attached to the rear face of said cup, said counterweight being offset from said bore in said given direction.

19. An apparatus for winding self-winding watches including a rotor, a watch face and a band comprising:

a) a rotatable shaft having a given axis and an outer end, said shaft being inclined upwardly toward said outer end at an angle of from about 0° to about 45° above horizontal, said shaft including a torque arm having an outer end moveable along a circular pathway upon rotation of said shaft;

b) a watch carrier with a cup section having an inner face with a shaft receiving bore for receiving the end of said shaft, said cup section being freely rotatable on said shaft, a torque arm engaging projection being offset in a given direction from said bore and extending from said rear face, and a watch support removably insertable within said cup, said watch carrier having a center of gravity offset from said shaft in a given direction; and c) a drive means for rotating said shaft, said torque arm engaging said torque arm engagement projection upon rotation of said shaft until said counterweight reaches the apex of said rotation, whereupon said carrier is released to freely rotate about said axis with said counterweight being carried bi-directionally beneath said axis in an oscillating motion to spin said rotor to wind said watch.

20. The apparatus of claim 19, wherein said drive means is an electrically powered motor.

21. The apparatus of claim 19, further including a housing supporting said shaft, drive means and watch carrier.

22. The apparatus of claim 19, wherein said carrier includes a counterweight offset from said shaft in said given direction.

23. The apparatus of claim 19, wherein said carrier is adapted to support a watch in the upright position when said given direction is in the downward direction.

24. The apparatus of claim 19, further including a controller to control activation of said drive mechanism.

25. The apparatus of claim 19, wherein said drive means is connected to said shaft through reduction gears.

26. The apparatus of claim 19, wherein said torque arm engagement projection is a rearwardly extending pin.

27. The apparatus of claim 19, including a counterweight attached to the rear face of said cup, said counterweight being offset from said bore in said given direction.

* * * * *

UNITED STATES PATENT AND TRADEMARK OFFICE

CERTIFICATE OF CORRECTION

PATENT NO. : 6,543,929 B1
DATED : April 8, 2003
INVENTOR(S) : Charles Agnoff

It is certified that error appears in the above-identified patent and that said Letters Patent is hereby corrected as shown below:

Title page,
Item [57], ABSTRACT,
Line 2, "an axis of rotation of 90° above horizontal" should read -- an axis of rotation of less than 90° above horizontal --

Signed and Sealed this

Sixteenth Day of September, 2003

JAMES E. ROGAN
*Director of the United States Patent and Trademark Office*